US008393379B2

(12) United States Patent
Marocco

(10) Patent No.: US 8,393,379 B2
(45) Date of Patent: Mar. 12, 2013

(54) SHUTTER WITH GEAR DRIVE FOR LOUVRES

(75) Inventor: Mario M. Marocco, Toronto (CA)

(73) Assignee: Maxxmar Inc.

( * ) Notice: Subject to any disclaimer, the term of this patent is extended or adjusted under 35 U.S.C. 154(b) by 230 days.

(21) Appl. No.: 12/923,772

(22) Filed: Oct. 7, 2010

(65) Prior Publication Data

US 2012/0085030 A1 Apr. 12, 2012

(51) Int. Cl.
*E06B 3/327* (2006.01)

(52) U.S. Cl. ..... 160/172 R; 49/82.1

(58) Field of Classification Search ..... 160/172 R, 160/172 V, 107, 168.1 V, 176.1 V, 344, 341, 160/340; 49/82.1, 87.1
See application file for complete search history.

(56) References Cited

U.S. PATENT DOCUMENTS

| | | | | | |
|---|---|---|---|---|---|
| 2,651,085 | A * | 9/1953 | Kopp | 49/64 |
| 3,153,819 | A * | 10/1964 | Bond | 49/64 |
| 3,298,425 | A * | 1/1967 | Cayton et al. | 160/176.1 V |
| 3,468,360 | A * | 9/1969 | Payne | 160/172 R |
| 4,193,438 | A * | 3/1980 | Pastore | 160/168.1 V |
| 4,316,493 | A * | 2/1982 | Arena | 160/168.1 V |
| 5,052,150 | A * | 10/1991 | Chen | 49/82.1 |
| 5,501,261 | A * | 3/1996 | Peale | 160/168.1 R |
| 5,839,492 | A * | 11/1998 | Young | 160/107 |
| 7,328,533 | B1 * | 2/2008 | Coleman | 49/74.1 |
| 2007/0204513 | A1 * | 9/2007 | Griffiths | 49/82.1 |

* cited by examiner

*Primary Examiner* — David Purol

(57) ABSTRACT

A shutter of the type having a frame, and louvres extending from side to side within the frame, the louvres being rotatable about parallel axes, the side frames having a hollow interior, and defining longitudinal slots, and having a louvre control member within the frame for operating all louvres, drive connector members connected to the louvre control member for engaging respective louvres, and each drive connector member in turn having a first gear operated by the louvre control member, a second gear supporting and driving an end of a louvre, a drive housing supporting the first and second gears in meshing engagement, and, drive surfaces on the first gear for interengaging with the louvre control member.

12 Claims, 5 Drawing Sheets

SHUTTER WITH GEAR DRIVE FOR LOUVRES

FIELD OF THE INVENTION

The invention relates to shutters of the type having a frame, and louvres rotatable in the frame, and a control system connected to the louvres, for rotating them open and closed, and in which the louvres can be raised or lowered within the frame, as well as being rotatable, open or closed

BACKGROUND OF THE INVENTION

Shutters for windows and doors usually have a frame, mounted in the window or door opening, and rotatable louvres extending across the frame, from side to side. A control system is connected to the louvres. Moving the control system rotates all the louvres. In this way the louvres can be tilted open for light and air, or tilted up or down and closed for privacy.

Shutters have been made in this general pattern for hundreds of years. The rotation drive for control of the louvres, in the past, may be as simple as a push/pull bar. In more modern designs the side frames have been hollow, and a rotation control mechanism has been provided within the side frames. Such systems have been more or less satisfactory, for the purposes for which they were intended.

However, as the taste of consumers becomes more varied, and knowledgeable, there is a need for shutters in which not only are the louvres rotatable, but in which the louvres are also capable of being raised or lowered within the frame, somewhat in the manner of a Venetian blind, for example.

This freedom would be impossible with the old style push bar control. It is practically unworkable for most more complex concealed rotation control mechanisms.

The provision of both rotation control and raising and lowering control presents complex problems. In particular, while such dual operation may have been proposed in the past, the mechanism required numerous small parts, and complex operation. As a result, the cost of such dual operation shutters would have been too high for consumer acceptance. Making so many little parts would require many different tools. Assembling them would require much trained manual labour. Servicing such dual operation shutters, to correct faults would be costly. In addition to these obvious drawbacks, a shutter must be assembled with all the louvres lying in parallel planes. Achieving this arrangement with a complex drive system required great thought in the engineering of the shutter, and in selecting the appropriate spacing between adjacent louvres. Drilling of pivot holes in the side frames, to accommodate the louvre pivots, had to be selected and positioned to provide exact spacings for the louvres. Clearly if such shutters are to be acceptable to consumers, these problems must be addressed and dealt with in an effective and economical manner.

The invention does this by providing separate drive connector assemblies for each louvre which are made of only three components. Each drive connector assembly is moveable up and down within the hollow side frame.

At the same time the drive connector assemblies preferably provide pivots axes for each louvre.

This does away with the need for drilling pivot holes in the side frames. The side frames simply define longitudinal slots, through which the louvre pivots can access the drive connector assemblies.

BRIEF SUMMARY OF THE INVENTION

In order to achieve at least some of these features, the invention provides a shutter of the type having a frame, and louvres extending from side to side within the frame, the louvres being rotatable about parallel axes, the side frames having a hollow interior, and defining longitudinal slots, and having a louvre control member within at least one side of the frame for operating all louvres, drive connector members connected to the louvre control member for engaging respective the louvres, and each drive connector member in turn defining a first gear operated by the louvre control member, a second gear connected to a louvre, a drive housing supporting the first and second gears in meshing engagement, and, drive surfaces on the first gear for inter-engaging with the louvre control member.

Preferably the louvres have drive pins at each end and the second gear has a recess for receiving a drive pin of a louvre.

Usefully the louvre control member is of non circular shape in section, and the first gears have through openings of corresponding shape to receive the louvre control member.

Preferably the louvre drive pins are of non circular shape and the second gear recesses are of corresponding shape.

Preferably the drive housing has a first gear bearing and a second gear bearing for supporting respective first and second gears.

Usefully the first and second gears are bevel gears and are arranged on respective gears axes at 90 degs to one another.

Preferably the drive housing has first and second walls lying in planes at 90 degs to one another, and each defining its respective gear bearing.

Preferably the first gear defines a body with the gear intermediate its ends and first gear bearings at each end of the body, and the second gear defines a body with the gear at one end and a bearing intermediate its ends.

Preferably the drive housing defines two spaced apart first bearing walls for said first gear bearings, and a second gear bearing wall, intermediate said two first gear bearing walls, for supporting said second gear.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

DESCRIPTION OF A SPECIFIC EMBODIMENT

Figure 1:
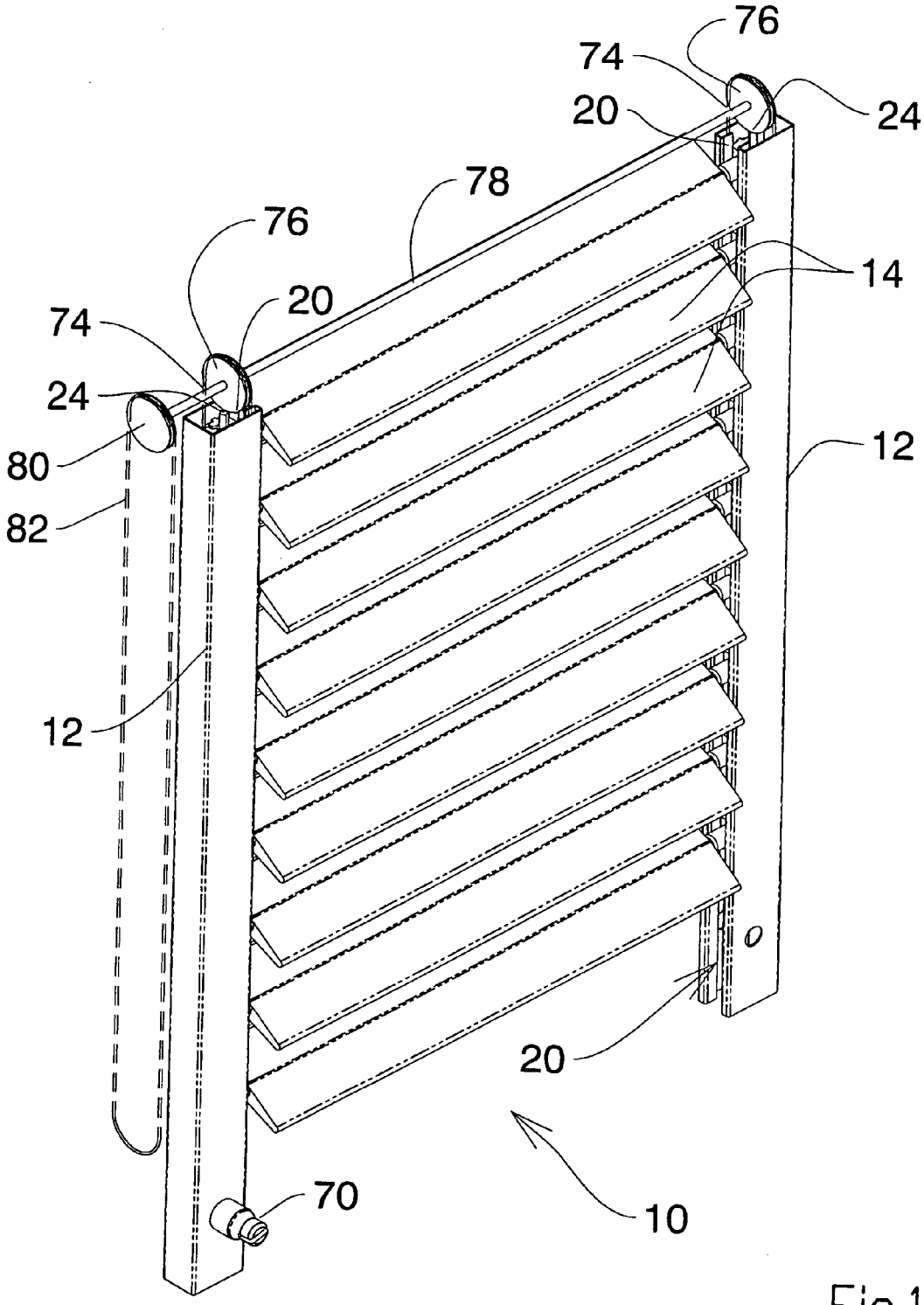
FIG. 1 is a perspective on a portion of a shutter illustrating the invention.
Figure 2:
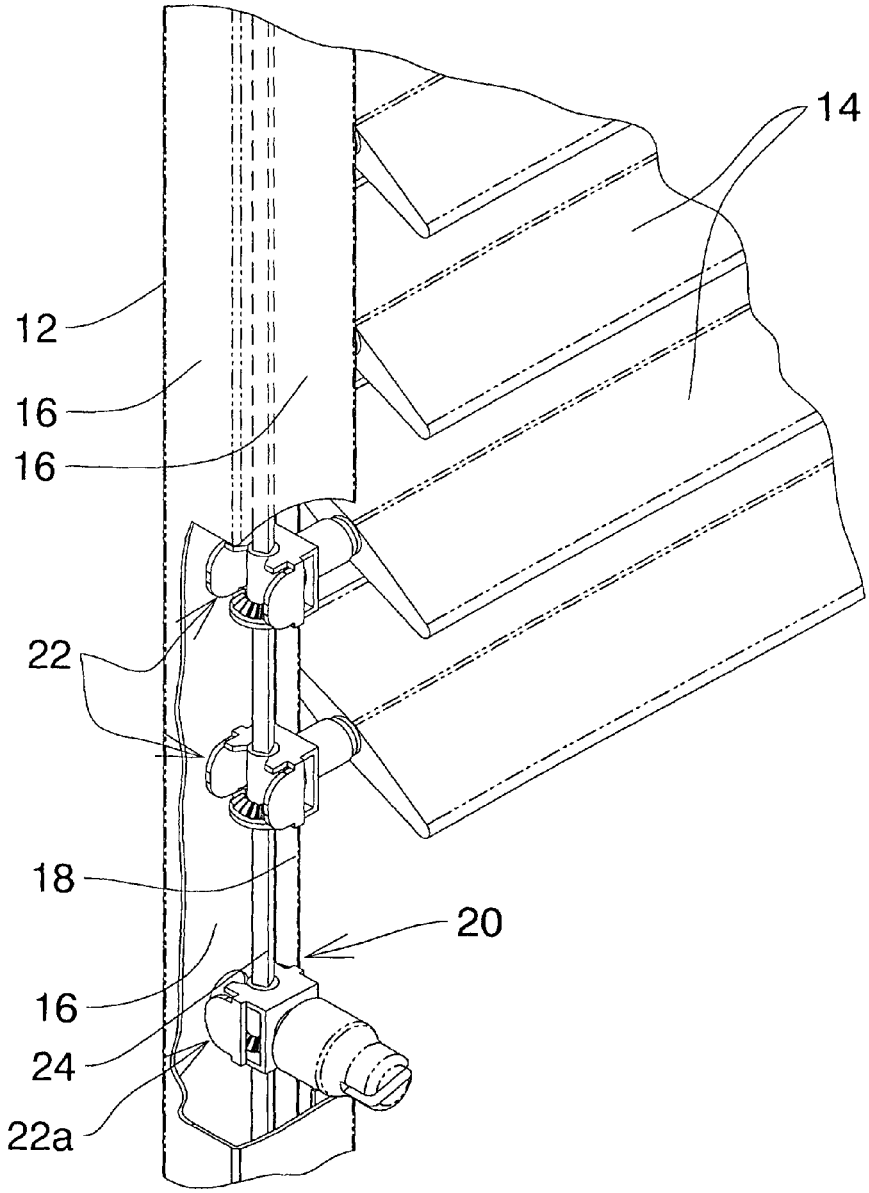
FIG. 2 is a perspective illustration showing a side frame partially cut away and showing louvre drive member and louvre drive connectors retained therein.
Figure 3:
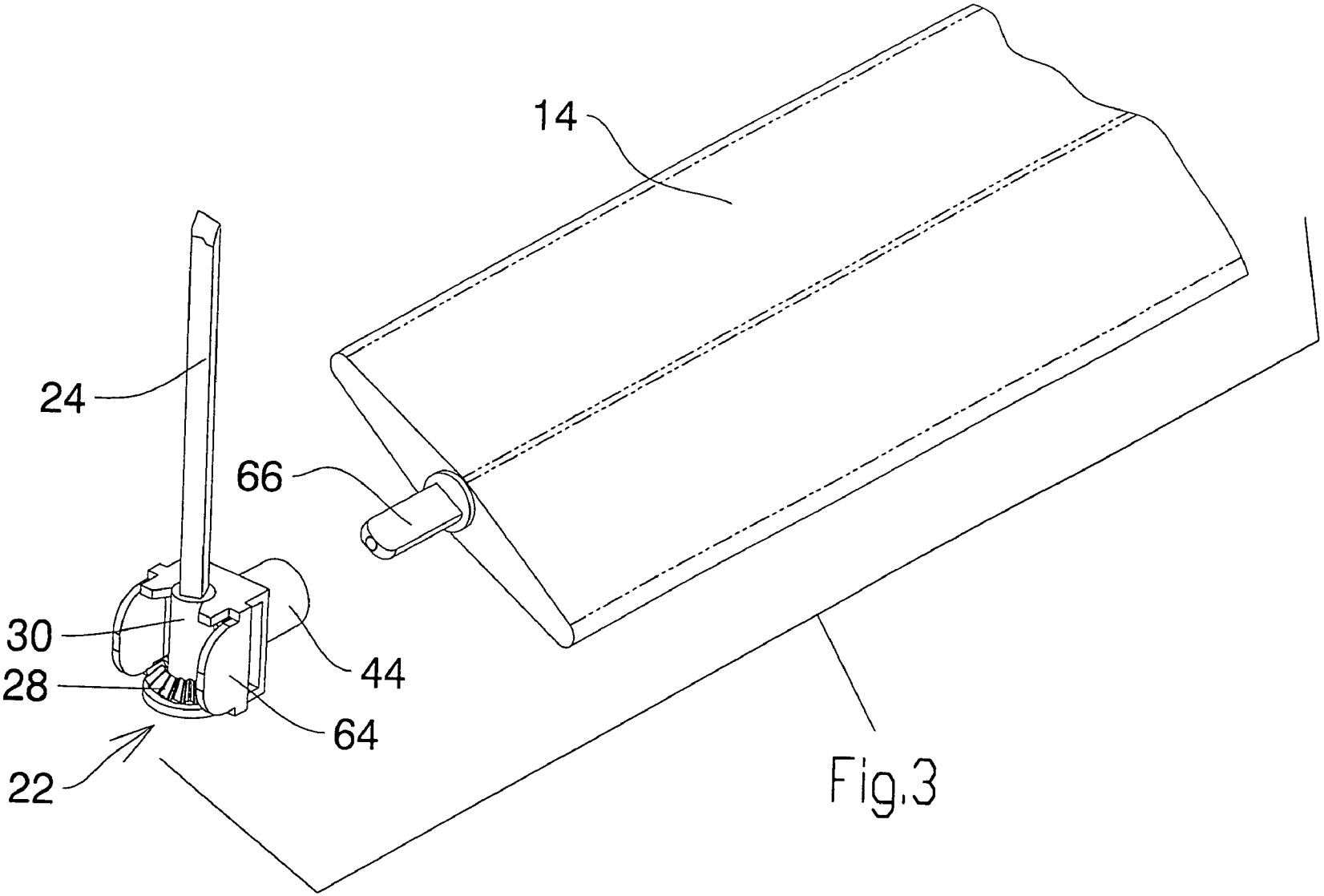
FIG. 3 is an exploded perspective illustration showing a louvre drive connector partly cut away and portions of a louvre.
Figure 6:
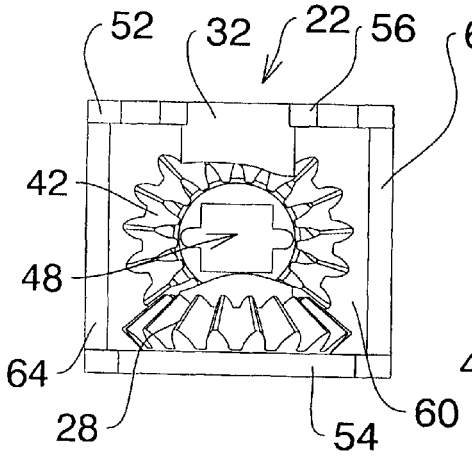
FIG. 6 is a section along line 6-6 of FIG. 4.
Figure 5:
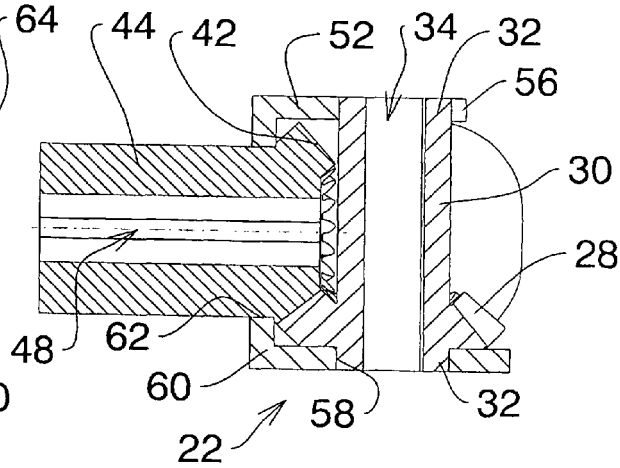
FIG. 5 is a section along line 5-5 of FIG. 4.
Figure 4:
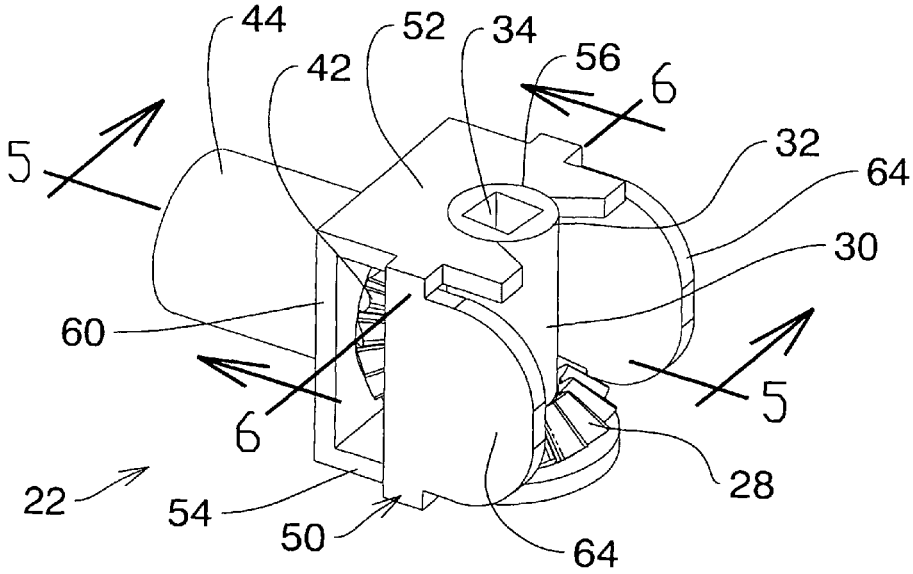
FIG. 4 is an isometric view of the louvre drive connector and gears.
Figure 7:
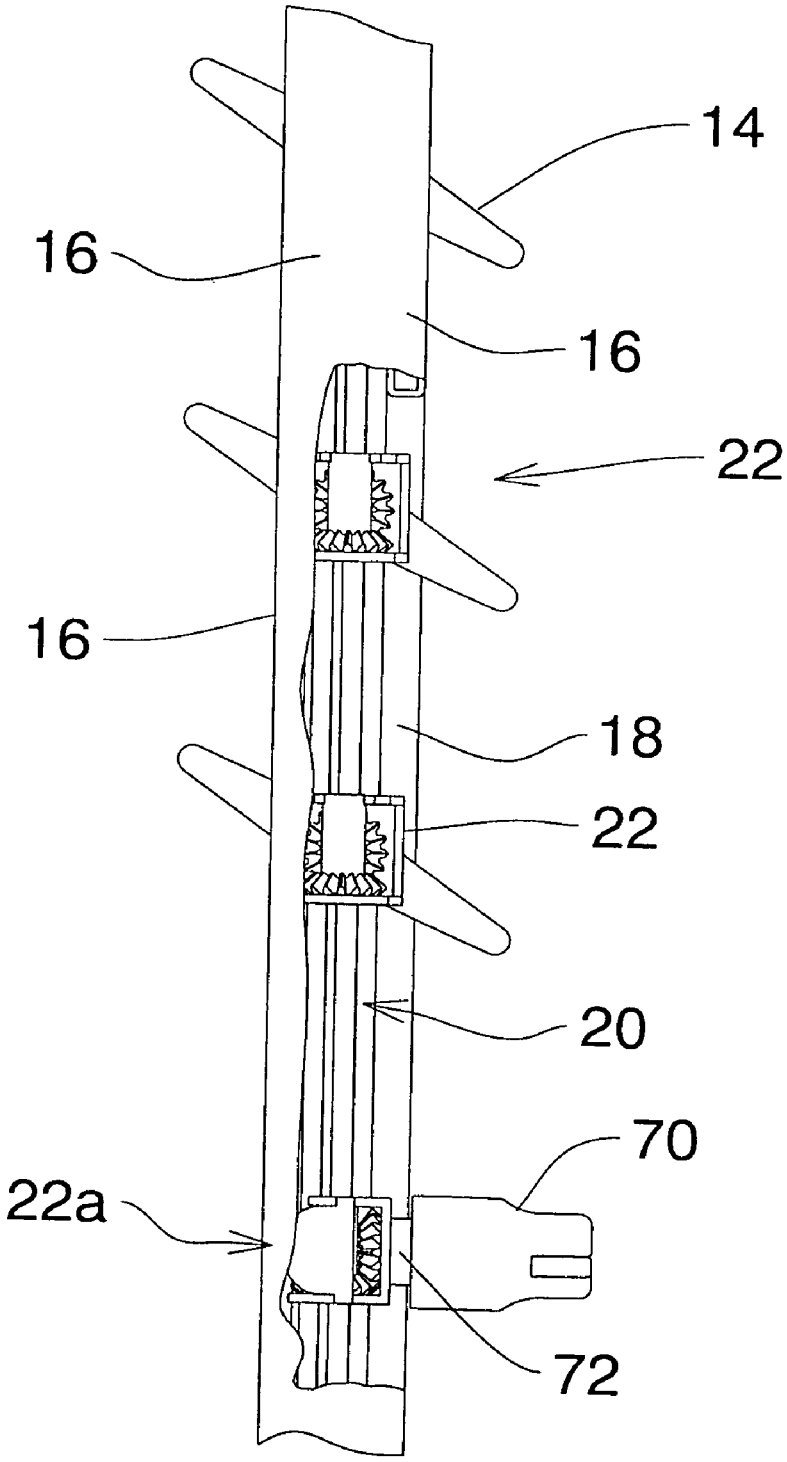
FIG. 7 is a side view, partly cut away, of a side frame, showing locations and spacings of louvres, and the control mechanism

Referring to FIG. 1 it will be seen that this illustrates an embodiment of the invention, in the form of a shutter (10)

having a frame with side members (12). The frame will also have top and bottom members.

Louvres (14) extend from side to side of the frame, at spaced intervals. As is well known such louvres (14) are rotatable between open and closed positions. In simple domestic shutters the louvres are permanently installed in their frames. However in this improved form of shutter, the louvres (14) are supported in individual drive connectors, which are concealed within the frame, and which can be raised up and lowered, in a manner described below.

As is best shown in FIGS. 2, 3, 4, 5, 6 and 7, the side frame members (12) are four sided hollow metal channels, in this case. Top and bottom frame members (not shown) would normally be provided, and made from the same channel section. The side frame members comprise three channel walls (16) and a fourth slotted wall (18) defining a lengthwise slot (20)

Louvres (14) are supported between the two side frame members (12)

Within the hollow side frame members (12) there are located a plurality of drive connector assemblies (22). The drive connector assemblies (22) are separate from one another and may be slideable up and down within the hollow side frame members (12), or may be fixed (in a more economical embodiment). A louvre control member (24) extends lengthwise within each side frame member (12).

The louvre control member (24) is an elongated rod, preferably metallic, of non circular shape in section. In this case a square shape is selected for simplicity. Each of the drive connector assemblies (22) is fitted onto the louvre control member (24), in a manner described below.

Rotation of the louvre control member (24) in a side frame member will control all drive connector assemblies (22) within that side frame, in a manner described below. Each of the drive connector assemblies (22) comprises three components. A first bevel gear (28) is formed integrally on a hollow, generally cylindrical body (30), having rotational surfaces or bearings (32) at each end. The first gear (28) is located intermediate the two ends of the body (30). A central axial opening (34) extends through body (30). Opening (34) has a cross section which is non circular, in this case square, complementing the shape of the louvre control member (24). This allows the louvre control member (24) to pass through each of the bodies (30) of the first gears (28) of each of the drive connector assemblies (22).

Each of the drive connector assemblies (22) has a second bevel gear (42) formed integrally with a generally cylindrical body (44). In this case the gear (42) is located at one end of the body (44). The body (44) defines a rotational surface intermediate its ends, adjacent the second gear, and a bore with a non circular section (48). The gear tooth rings of the first and second gears mesh for example at right angles. The third component of the drive connector assemblies is the housing (50). Housing (50) has two first gear support walls (52) and (54). These two walls are located in parallel planes spaced apart from one another. First gear support wall (52) defines an arcuate bearing recess (56), describing slightly more than a semi-circle, which acts as a bearing for one end of the first gear body (30), and functions to capture the first gear body, and position it for rotation. The other first gear support wall (54) has a circular bearing opening (58), lying along a common rotation axis with bearing recess (56). Bearing opening (58) receives the other end of first gear body (30) and supports it for rotation.

An intermediate second gear wall (60) extends between the two first gear walls, and lies in a plane normal to them. Second gear wall (60) has a circular bearing opening (62), which receives the second gear body (44). Second gear body (44) extends through opening (62), and opening (62) functions as a bearing to support second gear body for rotation.

Housing (50) also has two side walls (64) which simply function as guides within side frame members (12).

Each of the louvres (14) has an axle pin (66) extending from each end. Axle pins are received in bores (48). Axle pins have a non circular section complementing the section of bores (48) of second gear bodies (44).

In one embodiment (FIGS. 1 and 7), a manual control knob (70) may be mounted on one of side frame members (12).

Within side frame member (12), a drive control assembly (22*a*) is positionednormal to the other drive assemblies (22). Knob (70) has a shaft (72) (FIG. 7) which passes through wall (16) and into the second gear bore (48) of the drive connector assembly (22*a*). Rotation of knob (70) will thus cause rotation of second and first gears (42) and (28) in that drive connector assembly (22*a*).

Rotation of first gear (28) will thus rotate the louvre control member (24).

Rotation of the louvre control member (24) will cause rotation of all the other first gears (28) in the remaining drive connector assemblies (22).

Rotation of the first gears (28) will cause rotation of all the second gears (42) and thus rotate the louvres (14) themselves.

In some cases it may be that even the manual control knob (70) is not required. Manual rotation of any one of the louvres (14) themselves, will cause rotation of all the louvres in that shutter.

In another embodiment provision may be made for power operation of the louvre control member (24). Such power operation may be desirable, for example, on shutters that may be awkward to reach for some reason. Remote switching devices (not shown) may be used in this case. Such power operation may be provided by an electric motor (not shown) mounted on one side member (12) of a shutter, in a manner somewhat similar to the mounting of knob (70). Remote operation is not illustrated since it is well known.

Provision may be made to raise (and to lower) the louvres (14) within the side members. This extra feature may be desired by some consumers, who may wish to provide for a clear unobstructed view through a window, for example.

This may be achieved (FIG. 1) by raise cords (74) within side frame members (12). These cords may be operated manually by pulleys (76), shaft (78), pulley (80) and cord (82), or may be powered by any suitable means.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A shutter of the type having a frame, and louvres extending from side to side within the frame, the louvres being rotatable about parallel axes, the side frames having a hollow interior, and defining longitudinal slots, and comprising;

a louvre control member within at least one side of the frame for operating all louvres;

drive connector members connected to said louvre control member for engaging respective said louvres, and each said drive connector member in turn defining, a first gear operated by said louvre control member;

a second gear supporting and driving an end of a louvre;

a drive housing supporting said first and second gears in meshing engagement said drive housing having two first gear bearing walls lying spaced apart in parallel planes and each said bearing wall defining respective first gear bearings;

said first gear defining a cylindrical body having two ends, with the first gear intermediate its ends, and said cylindrical body forming rotation surfaces on both said ends, on either side of said first gear, said cylindrical surfaces being received in said respective first gear bearings in respective said first bearing walls and, drive surfaces on said first gear for interengaging with said louvre control member.

2. A shutter as claimed in claim 1 wherein said louvres have louvre pivot pins at each end and the second gear has a recess for receiving a pivot pin of a louvre.

3. A shutter as claimed in claim 2 wherein said louvre control member is of non circular shape in section, and the first gears have through openings of corresponding shape to receive the louvre control member.

4. A shutter as claimed in claim 3 wherein said louvre pivot pins are of non circular shape in section and the second gear recesses are of corresponding shape.

5. A shutter as claimed in claim 4 wherein the drive housing has a second gear bearing for supporting respective second gears.

6. A shutter as claimed in claim 5 wherein the first and second gears are bevel gears and are arranged on respective gears axes at 90 degs to one another.

7. A shutter as claimed in claim 6 wherein said second gear defines a cylindrical body with the second gear at one end and a rotation surface intermediate its ends.

8. A shutter as claimed in claim 7 wherein the drive housing defines an intermediate second gear bearing wall, intermediate said first gear bearing walls, for supporting said second gear body.

9. A shutter as claimed in claim 8 including an arcuate bearing opening defined in one of said first bearing walls, and a circular bearing opening defined in the other of said first bearing walls.

10. A shutter as claimed in claim 9 including a circular bearing opening formed in said second gear bearing wall.

11. A shutter as claimed in claim 10, wherein said second gear bodies are oriented on horizontal axes and extend within said side frames, towards said longitudinal slots, and wherein said louvre pins extend through said slots into said second gear body recesses.

12. A shutter as claimed in claim 10 including a raise member connected to said drive connector members operable to raise said drive connector members and said louvres.

* * * * *